US005694747A

United States Patent [19]

Tesch

[11] Patent Number: 5,694,747

[45] Date of Patent: Dec. 9, 1997

[54] PROCESS FOR MAKING A CUSHION, A QUILT, OR THE LIKE, FILLING MATERIAL CARTRIDGE SUITABLE FOR CARRYING OUT THE PROCESS, PROCESS FOR MAKING THE FILLING MATERIAL CARTRIDGE, AND ENVELOPE SUITABLE FOR CARRYING OUT THE PROCESS

[76] Inventor: Günter Tesch, Avenue Jean-Marie-Musy 15, CH-1700 Fribourg, Switzerland

[21] Appl. No.: 669,374

[22] PCT Filed: Nov. 13, 1995

[86] PCT No.: PCT/EP95/04456

§ 371 Date: Jul. 10, 1996

§ 102(e) Date: Jul. 10, 1996

[87] PCT Pub. No.: WO96/15065

PCT Pub. Date: May 23, 1996

[30] Foreign Application Priority Data

Nov. 11, 1994 [DE] Germany ..... 44 40 442.5

[51] Int. Cl.[6] ..... B65B 1/04

[52] U.S. Cl. ..... 53/469; 53/436; 53/459; 141/10; 141/114; 141/313

[58] Field of Search ..... 53/469, 473, 459, 53/529, 436, 433; 141/10, 313, 114, 67

[56] References Cited

U.S. PATENT DOCUMENTS 2,057,121 10/1936 Trevellyan ..... 53/473
2,653,744 9/1953 Behr .
3,213,587 10/1965 Carruthers ..... 53/473
3,611,524 10/1971 Broyles .
4,094,126 6/1978 Lamb ..... 53/473

FOREIGN PATENT DOCUMENTS 0 203 469 12/1986 European Pat. Off. .
91 07 123 8/1991 Germany .

*Primary Examiner*—Daniel Moon
*Assistant Examiner*—John Paradiso
*Attorney, Agent, or Firm*—Bacon & Thomas

[57] ABSTRACT

A process is described for filling an envelope of a cushion, a quilt, or the like, which envelope is essentially closed envelope with a closable filling opening, and having a filling material of individual aggregates, e.g. fiber aggregates, down, feathers, pieces of foam material. The reversibly compressible aggregates, which are in a separate filling material cartridge that has a far smaller volume than the maximum volume of the envelope and which are thus under high pressure, are introduced into the envelope through the opening along with at least a part of the filling material cartridge, whereupon the filling material cartridge is opened inside the envelope and the envelope is filled as the aggregates expand out from the filling material cartridge. This novel filling operation can be carried out by the specialty retailer or even by the end customer without additional special filling equipment.

17 Claims, No Drawings

PROCESS FOR MAKING A CUSHION, A QUILT, OR THE LIKE, FILLING MATERIAL CARTRIDGE SUITABLE FOR CARRYING OUT THE PROCESS, PROCESS FOR MAKING THE FILLING MATERIAL CARTRIDGE, AND ENVELOPE SUITABLE FOR CARRYING OUT THE PROCESS

DESCRIPTION

1. Technical Field

The invention relates to a process for making a cushion, a quilt, or the like, according to the preamble to claim 1, a filling material cartridge suitable for carrying out the process, a process for making the cartridges of filling material, and a envelope suitable for carrying out the process.

2. Prior Art

Up till now, cushions, quilts, or the like have been made by means of a envelope being filled with a particular quantity of filling material at the manufacturer or retailer, after which the envelope is closed before the final article is presented to the retailer or the end customer. At least, the end customer always receives a completely filled article such as a cushion, e.g. a pillow, a quilt, e.g. a bed cover, or the like. More often, the essentially closed envelopes have a filling opening which can be opened and closed again.

For example, a filling machine from the Lorch Company is used to fill cushions and blows a weighed out quantity of filling material into the cushion envelope, after this material has been further cleaned if need be. When the previously weighed out quantity of filling material is blown in, often a part of the filling material gets caught in the filling machine and its individual mechanisms. This filling material must be subsequently filled by hand.

If the cushion or the cover is filled with filling material by hand, for example, then the filling material that has been filled is usually clumpy. Therefore, the filling material in the filled cushion or in the filled quilt must be fluffed up again.

The completed cushions, quilts, or the like have a relatively large volume since in addition to the filling material, there is also a great deal of air in them.

In order to reduce this volume during transport, cushions that are already completely filled are packed into a plastic envelope, for example. This plastic envelope containing the cushion is compressed to withdraw a part of the air contained in it and consequently has a smaller volume than the cushion itself when it is ready for use. As a result, a smaller volume is required for transport of the finished cushion to the place it will be used.

Packed cushions of this kind are difficult to sell and their contents must be fluffed up before they are used. Also, the envelope becomes creased when the cushion is compressed.

Since as a rule, cushion envelopes are already filled with the filling material on the manufacturing end, the end customer has to purchase cushions with a predetermined fill ratio. Filling one and the same size of cushion with different fill ratios significantly increases the inventory at the manufacturer and at the retailer.

INVENTION

The object of the invention is to give the end customer in particular, the opportunity to make a cushion, a quilt, or the like according to his wishes. Furthermore, the transport volume of the article should be reduced as much as possible.

This object is attained by the process according to the present invention. The process of the present invention is a process for making a cushion, a quilt, or the like, having an essentially closed envelope that has a closable filling opening and a filling material of individual aggregates. The individual aggregates are, for example fiber aggregates, down, feathers, pieces of foam material. The reversibly compressible aggregates, which are in a separate filling material cartridge that has a far lower volume than the maximum volume of the envelope and which are thus under high pressure, are introduced into the envelope through the opening along with at least a part of the filling material cartridge is opened inside the envelope, and the envelope is filled as the aggregates expand out from the filling material cartridge.

The essential consideration in attaining the object is to provide envelope manufacture separate from filling. Furthermore, the filling material is compressed for transport purposes. In this way, the end user can combine a envelope with a particular fill quantity, as he sees fit.

Because the filling material is packed into a filling material cartridge and the filling material is compressed, when the filling material cartridge is correctly opened in the envelope, the filling material expands almost explosively and the individual units of filling material are distributed evenly in the envelope. They essentially reassume the volume that they had before the compressed packing.

The envelope is closed after being filled with filling material, for which purpose it can have a zipper, for example.

In the filling material cartridge, the aggregates are kept under a far greater pressure than in the envelope into which they are filled. As a result, after the opening of the filling material cartridge, due to the high pressure in the filling material cartridge, the aggregates can fill the cushion envelope at least partially in a self-expanding manner.

Despite the compression of the aggregates, in particular the fiber aggregates, upon their expansion, they approximately reassume their original volume.

According to a preferred step of the process, after the closing of the envelope opening, the filled envelope, in particular the filled cushion, is shaken or beaten to distribute the aggregates in the envelope. An optimum distribution of the filling material in the envelope can be achieved by the shaking and/or beating of the filled envelope, even when there are aggregates still massed together.

According to a preferred embodiment, fiber aggregates of fibers oriented with respect to one another are used as the aggregates and are preferably spherical or are intricately tangled with one another. However, feathers, down, pieces of foam material, and mixtures of some or all four types of aggregates may be used.

In fact, EP-A-0 203 469 discloses packing ready-made fiber aggregates loosely in sacks and transporting them to the cushion manufacturer or the like. The fiber aggregates are compressed under moderate pressures, in this case, densities between 75 or 100 g/l were tested.

This case explains that the fiber aggregates can be sucked out of the sack like down and blown into cushions. But this has nothing to do with the present invention since according to the invention, the fiber aggregates provided for a particular envelope are compressed in a filling material cartridge and the user of the upholstered article, such as a pillow, quilt, cushion, or the like, is intended to fill all the aggregates of a pack into a envelope, the filling material cartridge being opened into the envelope, while according to the known transport process, the aggregates are sucked out.

A filling material cartridge that is filled with aggregates and is suitable for carrying out the process for filling a envelope with the aggregates, in particular fiber aggregates, has a volume that corresponds to one third to one thirtieth the volume of the loose, unwrapped, or unpacked fiber aggregates. Preferably, the filling material cartridge has a volume that corresponds to one fifth to one twentieth the volume of the loose, unwrapped aggregates.

Correspondingly, the filling material cartridge filled with the aggregates has a volume that corresponds to one half to one twentieth the volume of the envelope.

The filling material cartridge is advantageously comprised of a tube that is closed on both of its longitudinal ends and can be slid into the open envelope with its one end at least, but if possible can be slid completely into it. The tube which constitutes the filling material cartridge can be made of plastic.

In a suitable manner, the filling material cartridge has a predetermined breaking point which, after a slight opening, opens further by itself due to the pressure of the aggregates and permits an expansion of the aggregates. If the tube is then cut open, for example by means of a knife, from one end toward the other and thus also toward the opening of the envelope of the cushion, the quilt, or the like, then the filling material expands out of the filling material cartridge into the envelope.

According to a particular embodiment, the filling material cartridge has an elongated shape, preferably the shape of a circular cylinder.

Thus, an elongated plastic pouch that is open on one longitudinal end can be filled with the filling material under intense compression and this longitudinal end can be closed after filling.

A envelope suitable for carrying out the process, such as a cushion envelope, quilt cover, or the like, preferably has a closable opening, in particular a zipper, which the user of the cushion can close after filling it by means of the fiber aggregates that have expanded out from the filling material cartridge.

The density of the aggregates in g/l is determined by measuring the weight and the volume of the aggregates at a particular pressure (density=weight/volume). While the measurement of the weight is carried out by weighing a particular quantity of aggregates, the measurement of the different volumes is explained in more detail below.

The weighed quantity of aggregates is loosely poured into a measuring cylinder; the aggregates should not mass together during loading. In order to obtain reproducible results, a flat plate whose outer diameter is slightly smaller than the inner diameter of the measuring cylinder is placed upon the filled aggregates. The mass of the plate is calculated so that it exerts a pressure of 0.1 $cN/cm^2$ on the column of aggregates. Furthermore, it should be noted that the volume of the filling material in-relation to the geometry of the measuring cylinder is calculated so that the height of the loaded column of aggregates is at least one third the inner diameter of the measuring cylinder.

The fill height of the aggregates is determined, which yields the filled volume of aggregates. The quotient of weight of the aggregates divided by the volume of the aggregates yields the density of the loose aggregates.

To determine the maximum volume of the envelope, and therefore to ascertain the density of the aggregates in a envelope, for example the cushion envelope, the envelope is filled full with small styrofoam balls whereupon the volume of this quantity of styrofoam balls is measured in a measuring cylinder. Styrofoam balls that have a diameter between 2 mm and 4 mm are used for the measurement.

Determining the density of the aggregates in the filling material cartridge is carried out in an analogous manner. Here, too, the volume of the filling material cartridge is determined by means of styrofoam balls; the starting point is always an equal quantity of aggregates, i.e. an equal weight.

Because the same weight of aggregates is always used, the ratio of the three different volumes indicates the ratio of the three different densities, and in inverse proportion, the compression factor.

In this manner, for example, a cushion whose envelope has outer measurements of 50 cm * 70 cm is filled with fiber aggregates having a total weight of 450 g. When loose, these fiber aggregates have a density of approximately 12 g/l, i.e., they have a volume of 37.5 l. If this quantity of 450 g of fiber aggregates is compressed into a filling material cartridge with a compression ratio of 1:20, then the volume of 37.5 l is reduced to approximately 1.9 l. Then the density in the filling material cartridge is 240 g/l.

Since the envelope that is to be filled with the fiber aggregates has a far greater volume than the filling material cartridge, namely approximately 25 l in the embodiment described here, and the fiber aggregates are reversibly compressible, the fiber aggregates can relax again in the envelope and fill it completely. Inside the envelope, e.g. a completely filled, non-loaded pillow, the density is for example 18 g/l, so there is a compression factor of 1:1.5 in relation to the loose fiber aggregates.

Then the compression ratio of the loose fiber aggregates to the fiber aggregates filled in the cushion to the fiber aggregates in the filling material cartridge is 1:1.5:20.

If a cushion envelope is now selected whose maximum volume is only half as great as the volume of the envelope described above, but the same filling material cartridge filled with fiber aggregates is used to fill this envelope, then the density of the fiber aggregates in this cushion increases and the compression ratio is 1:3:20.

A cushion of this kind is much firmer than the cushion described previously.

With an equal maximum cushion volume, it is also possible to fill the one envelope with the contents of two filling material cartridges.

From this, it follows that the inventory at the retailer can be kept smaller since the cushion size and fill quantity desired by the customer are picked by the customer and not by the cushion manufacturer.

To fill a filling material cartridge, an elongated plastic tube that is open on its one end is slid over the one end of a fill pipe. The outer diameter of this pipe approximately corresponds to the diameter of the tube so that the tube is tightly coupled to the pipe. The desired quantity of aggregates, e.g. fiber aggregates, is poured into the free end of the pipe and the aggregates are pressed into the tube by means of a plunger slid into the pipe. This plunger pushes away from the fill pipe, counter to a resistance acting upon its free end, until the end of the plunger pressing on the aggregates is pressed out of the pipe. After that, the tube end that has been open up to this point is closed, which can be carried out by means of a band or by means of the tube being cut by a torch. The possibly protruding end of the tube is removed.

During transport of the filling material cartridge and the envelope, a filling material cartridge with a minimum fill quantity required for this envelope size can be placed inside the envelope at its end remote from the opening; the rest of the envelope is wrapped around the already wrapped filling material cartridge. As a result, this cartridge is better protected during transport.

Depending upon the fill ratio, that is, depending upon the compression ratio of the filling material cartridge, this cartridge can be manufactured of varying thicknesses of plastic sheet material. If the filling material in the cartridge has a volume that corresponds to approximately one third the volume of the unpacked, uncompressed filling material, then the sheet material used can have a thickness of 20 μm. Since with a greater compression ratio, the pressure in the cartridge is significantly greater, the sheet material must then also be thicker. At a compression ratio of 1:10, the thickness is then approximately 80 μm. The thickness naturally also depends upon the kind of sheet material.

I claim:

1. A process for an essentially closed envelope that has a closable filling opening and having a filling material of individual reversibly compressible aggregates of fiber aggregates, down, feathers, or pieces of foam material, characterized in that the reversibly compressible aggregates, in sufficient quantity to fill the envelope, are contained in a separate filling material cartridge that has a volume which is one third to one thirtieth of the maximum volume of the envelope to be filled and which are thus under high pressure, are introduced into the envelope through the opening along with at least a part of the filling material cartridge, the filling material cartridge is opened inside the envelope, and the envelope is filled as the aggregates expand out from the filling material cartridge.

2. The process according to claim 1, characterized in that after the aggregates fill the envelope, its opening is closed.

3. The process according to claim 1, characterized in that after the opening of the filling material cartridge, the aggregates at least partially fill the envelope in a self-expanding manner, by means of the high pressure in the cartridge.

4. The process according to claim 1, characterized in that upon expansion, the aggregates reassume their approximate original volume.

5. The process according to claim 1, characterized in that after the closing of the envelope opening, the filled cushion envelope is shaken or beaten specifically to distribute the aggregates.

6. The process according to claim 1, characterized in that fiber aggregates of fibers oriented with respect to one another are used as the aggregates.

7. The process according claim 1, characterized in that feathers and/or down are used as the aggregates.

8. A filling material cartridge suitable for carrying out the process of claim 1 for filling an envelope with fiber aggregates, down, feathers, or pieces of foam material, characterized in that the filling material cartridge filled with the aggregates has a volume that corresponds to one fifth to one twentieth the volume of the loose, unwrapped aggregates.

9. The filling material cartridge according to claim 8, characterized in that the filling material cartridge that is filled with the aggregates has a volume that corresponds to one third to one twentieth, preferably one fifth to one fifteenth the volume of the envelope.

10. The filling material cartridge according to claim 8, characterized in that this cartridge is comprised of a tube that is closed on both of its longitudinal ends.

11. The filling material cartridge according to claim 8, characterized in that the tube is comprised of plastic.

12. The filling material cartridge according to claim 11, characterized in that the plastic tube has a wall thickness between 10 μm and 80 μm.

13. The filling material cartridge according to claim 8, characterized in that this cartridge has a predetermined breaking point that is easy to open and is preferably disposed in the longitudinal direction of the tube.

14. The filling material cartridge according to claim 8, characterized in that this cartridge has an elongated shape, preferably the shape of a circular cylinder.

15. A process for making the filling material cartridge according to claim 8, characterized in that an elongated tube that is open on one end, in particular a plastic tube, is filled with the filling material under compression and after filling, this longitudinal end is closed.

16. A envelope suitable for carrying out the process according to claim 1, such as a cushion envelope, quilt cover, or the like, characterized in that this envelope has a closable opening, in particular a zipper.

17. The process according to claim 1, characterized in that fiber aggregates of fibers which are tangled with one another are used as the aggregates.

* * * * *

UNITED STATES PATENT AND TRADEMARK OFFICE

CERTIFICATE OF CORRECTION

PATENT NO. : 5,694,747
DATED : December 9, 1997
INVENTOR(S) : Gunter TESCH

It is certified that error appears in the above-identified patent and that said Letters Patent is hereby corrected as shown below:

IN THE CLAIMS:

Claim 1, line 1, after "A process for" insert --filling--.

Claim 5, line 2, delete "cushion".

Signed and Sealed this

Third Day of March, 1998

*Attest:*

*Attesting Officer*

BRUCE LEHMAN

*Commissioner of Patents and Trademarks*